US010343819B2

(12) United States Patent
Schlarp

(10) Patent No.: US 10,343,819 B2
(45) Date of Patent: Jul. 9, 2019

(54) STACK FORMED OF BAGS

(71) Applicant: LEMO Maschinenbau GmbH, Niederkassel-Mondorf (DE)

(72) Inventor: Bernd Schlarp, Troisdorf (DE)

(73) Assignee: LEMO MASCHINENBAU GMBH, Niederkassel-Mondorf (DE)

( * ) Notice: Subject to any disclaimer, the term of this patent is extended or adjusted under 35 U.S.C. 154(b) by 0 days.

(21) Appl. No.: 15/313,007

(22) PCT Filed: Jul. 8, 2015

(86) PCT No.: PCT/EP2015/065608
§ 371 (c)(1),
(2) Date: Nov. 21, 2016

(87) PCT Pub. No.: WO2016/005450
PCT Pub. Date: Jan. 14, 2016

(65) Prior Publication Data

US 2017/0183129 A1 Jun. 29, 2017

(30) Foreign Application Priority Data

Jul. 8, 2014 (DE) ..... 10 2014 213 246

(51) Int. Cl.
*B31B 70/98* (2017.01)
*B65D 33/00* (2006.01)
(Continued)

(52) U.S. Cl.
CPC ..... *B65D 33/001* (2013.01); *B31B 70/98* (2017.08); *B65D 33/004* (2013.01); *B65D 33/01* (2013.01);
(Continued)

(58) Field of Classification Search
CPC ..... B65D 33/00; B65D 33/004; B65D 33/01; B65D 83/08; B65D 83/0805; B31B 19/98;
(Continued)

(56) References Cited

U.S. PATENT DOCUMENTS 3,033,257 A * 5/1962 Weber ..... B29C 65/743 383/37
4,106,395 A 8/1978 Rochla
(Continued)

FOREIGN PATENT DOCUMENTS

DE 2356878 A 5/1975
DE 2500964 A 7/1976
(Continued)

*Primary Examiner* — Bryon P Gehman
(74) *Attorney, Agent, or Firm* — Andrew Wilford

(57) ABSTRACT

The invention relates to a method for producing at least one stack (9) formed of bags (1), comprising the following steps: feeding tubular or semitubular material in order to form a bottom material layer (2) and a top material layer (3), introducing at least one weld seam (4) in order to connect the bottom material layer (2) and the top material layer (3) in order to form individual, but still connected bags (1), introducing a formatting fold (8) into the layer web, formed of still connected bags (1), separating the bags (1) connected in the formatted layer web into individual bags (1), wherein said bags (1) still have the formatting field (8), forming a packet of individual bags (1) into a stack (9) having a defined number of bags (1), and introducing at least one fold into the stack (9). The invention further relates to a bag (1), a stack (9), and a dispensing box (12).

10 Claims, 3 Drawing Sheets

(51) Int. Cl.

| | |
|---|---|
| ***B65D 33/01*** | (2006.01) |
| ***B65D 83/08*** | (2006.01) |
| *B31B 160/10* | (2017.01) |
| *B31B 155/00* | (2017.01) |

(52) U.S. Cl.
CPC ..... *B65D 83/0805* (2013.01); *B31B 70/982* (2017.08); *B31B 2155/00* (2017.08); *B31B 2155/0014* (2017.08); *B31B 2160/10* (2017.08)

(58) Field of Classification Search
CPC ... B31B 70/98; B31B 70/982; B31B 2155/00; B31B 2155/0014; B31B 2160/10
USPC ..... 206/554; 383/37; 493/186–268
See application file for complete search history.

(56) References Cited

U.S. PATENT DOCUMENTS

| | | | | |
|---|---|---|---|---|
| 4,151,787 | A | 5/1979 | Rohr | |
| 4,816,349 | A | 3/1989 | Matsui | |
| 5,823,933 | A * | 10/1998 | Yeager | B65B 61/188 493/210 |
| 6,412,253 | B1 | 7/2002 | Meyer | |
| 7,775,717 | B2 * | 8/2010 | DeLuca | B65D 31/10 206/554 |

FOREIGN PATENT DOCUMENTS

| | | | |
|---|---|---|---|
| DE | 8205209 | U | 7/1982 |
| DE | 19756122 | A | 6/1999 |
| FR | 2215036 | A | 8/1974 |
| WO | 2010091855 | A | 8/2010 |

* cited by examiner

STACK FORMED OF BAGS

CROSS REFERENCE TO RELATED APPLICATIONS

This application is the US-national stage of PCT application PCT/EP2015/065608 filed 8 Jul. 2015 and claiming the priority of German patent application 102014213246.0 itself filed 8 Jul. 2014.

The invention relates to a method of making at least one stack formed from bags, such a stack formed from bags, such a bag and a dispenser box according to the features of the preambles of the independent patent claims.

It is known that bags, in particular plastic bags (such as garbage bags, freezer bags or the like, for example) can be made and rolled up onto a roll while they are still connected to one another. A predetermined number of such bags will then be found on a roll. Then a user will separate the bags from one another sequentially, as needed, to use them for their intended purpose. This separation is accomplished, for example, when a user pulls off bags that until then have been connected to one another by perforations or welding, along these perforations.

DE 82 05 209 discloses a dispenser for a roll of plastic film bags consisting of a film tube provided with folds on each of its longitudinal edges and having transverse tear perforations with at least one partial through-cut, and upstream of same in the dispensing direction, a welded and transverse bag bottom seam, the dispenser being shaped as an approximately cylindrical sleeve with a dispensing slot for the film running in its longitudinal direction so that a tongue protruding angularly of the sleeve beyond an edge of the dispensing slot in the area of the partial through-cut in the tear perforation of the film tube projects from the film tube when it is pulled out of the sleeve, i.e. the tongue protrudes into the dispensing slot or almost completely bridges it and has an approximately rectangular basic shape, its width in the longitudinal direction of the sleeve being equal to or only somewhat smaller than the width of the respective partial through-cut in the tear perforation of the film tube.

This method of production and supplying bags has proven successful but there is the disadvantage that it is perceived by the user as an undesirable operation to have to separate the bags that are connected to one another via the perforation for the respective intended purpose. Furthermore from a logistics standpoint the shape of a roll presents certain disadvantages. The available package space cannot be utilized optimally with the roll, either in storage or in presentation for sale. Furthermore, it is very complex to provide such a roll with information about the type of bags on the roll and their properties.

Therefore, the object of the present invention is to provide a method of making at least one stack formed from bags, such a stack formed from bags, such a bag and a dispenser box, with which the disadvantages described in the introduction can be avoided.

This object is achieved by the independent patent claims.

According to the invention, a method of making at least one stack formed from bags including the following steps is provided:

a) forming from tubular material or half-tube material a lower layer of material and an upper layer of material thereon, b) with at least one weld seam (4) joining the lower layer of material and the upper layer of material to form a a) forming from tubular material or half-tube material a lower layer of material (2) and an upper layer of material (3) thereon, b) with at least one weld seam (4) joining the lower layer of material (2) and the upper layer of material (3) to form a layered strip of individual bags (1) that are still attached to one another, c) creating a formatting fold (8) in the layered strip of bags (1) that are still attached to one another, d) separating the bags (1) that are still attached to one another in the format folded layered strip to form individual bags (1) such that these bags (1) still each have the formatting fold (8), e) forming a stack (9) from individual bags (1), f) forming a fold in the stack (9). of individual bags that are still attached to one another, c) creating a formatting fold in the layered strip of bags that are still attached to one another, d) separating the bags that are still attached to one another in the format folded layered strip to form individual bags such that these bags still each have the formatting fold (8), e) forming a stack from individual bags, f) forming a fold in the stack.

The method presented above permits continuous production of individual bags to form at least one folded stack that has an angular shape (for example, a parallepipedal shape). These stacks are suitable for being held in a container, for example, a dispenser box. The container therefore also has an angular shape that corresponds approximately to the shape of the at least one stack to be accommodated in the interior of the container. The user can withdraw each bag individually from the stack with little application of force. It is also no longer possible for the user to damage or even destroy the bags when separating them. Each bag is made available to the user in a uniform quality. The combination of the formatting fold of the respective bag with the folding of the stack ensures that another bag will always be made available for removal from the stack even after removal of one bag from the stack and this also creates a compact stack that optimally utilizes the space within the container. Because of the angular shape, such containers as dispenser boxes can be stored very well (by optimally utilizing the available storage space) and can be presented well for sale (because large surfaces of the angular container are available for information for the consumers and/or product information in comparison with rolls). On removal of a bag, closures for secure closing of the bags may also be made available to the user. A continuous process is thus made available from the production of the bag up to the formation of stacks. Formation of packages, i.e. collecting individual bags to form an overall package and/or stack takes place for a variable but defined number of bags in each case. The layered strip is formed from at least two layers of material.

This method can be carried out continuously if tubular material, half-tube material or sheeting is made continuously by extrusion, for example. This method can be carried out discontinuously, i.e. batch-wise if the tubular material, half-tube or sheeting is supplied in rolls, for example. It is also conceivable to connect the materials supplied on rolls to the material of the next roll prior to consumption of a roll in order to obtain a quasi-continuous process. A batch process denotes processes that are processed as a stack, i.e. in strict succession. Therefore batch processes are also referred to as stack processing. In the sense of this process, material on rolls is supplied to the process in succession. The batch process or set operation is a discontinuous production process, in which a limited amount of material, for example, a roll, is supplied to the process as a whole and removed from it as a whole after conclusion of the production process, for example, as stacks form from bags in this process.

Folding can be carried out as a hard process in the sense of a fold or with a rounding. Any embodiment of a fold between these two extremes is also feasible. A fold is created in this process by means that cause a reversal in direction of the material. At least one fold may also be introduced into the material upstream from this process, for example, to form a tube or half-tube of the film.

Half-tube material refers to material that has undergone a reversal of direction to form an upper and a lower layer of material. This reversal of direction may also be interpreted as folding. Half-tube material can be supplied to the process or created in situ from sheeting material in the process. Half-tube material can also be created from two layers of sheeting material by forming a physically bonded seam longitudinally before being supplied to the process according to the invention or during performance of the process according to the invention. The physically bonded seam is created by gluing or welding, for example.

Tubular material is a material that is self-contained and made by extrusion, for example, or it has a longitudinally extending connection. This connection may be formed by physical bonding, for example, by adhesive or welding. If tubular material is exposed to a pressure between two flat surfaces, then a lower layer of material and an upper layer of material are formed. In the transition region between these two layers of material, the material undergoes a reversal of direction, which can also be interpreted as a fold.

In addition, according to the invention the stack is provided with a means for securing the stack to prevent it from accidentally falling apart. This securing device may be formed for example by a flexible element such as a wire, a tape or the like. The securing device may also be formed by enclosing the stack with shrink-wrap film. Alternatively, the securing device may be provided by wrapping the stack with paper, for example, formed as a banderole. Securing measures such a weighting the stack with a larger weight are covered by the idea of securing means. The individual bags may also be provided with adhesive spots for the purpose of securing in order to attach the individual bags of the stack to one another, and this means of securing should also be easily overcome for the purpose of using the individual bags. The securing means can also ensure transport of the stack from stack production to packaging for example. This ensures that the positions of the bags within the stack does not change during transport. The stack provided with a securing means may also be incorporated in order to maintain the repackaging later or to leave the storage site without further packaging measures. The stacks provided with the securing means described above may be sent to storage and/or transport as well as sale, and as an alternative it is also conceivable to send the stack provided with the securing means to the container. However, it should be recalled here that the securing means must be removed, if necessary, when individual bags are to be dispensed from the container and thus from the stack.

In addition, according to the invention the stack is transferred to a dispenser box. The method described above permits continuous production of individual bags and collection of bags to form a stack for accommodation in a dispenser box. Removal of each individual bag from the dispensing opening of the dispenser box is made possible, for example, by the formatting fold of the individual bags and the subsequent folding that is implemented for example as Z-folding or U-folding to form the stack. The user can remove each bag individually from the dispenser box with little application of force. The bags also can no longer be damaged or even destroyed by the user. Each bag is supplied to the user in the same uniform quality. Due to the combination of the formatting folding with further folding of the Z-folding or U-folding, for example, it is advantageously ensured that after removal of a bag another bag will always be made available for removal. This takes place from the first removal of bags from the dispenser box to the last. With the removal of a bag, closures for secure closing of the bags may also be made available to the user. A continuous process is thus made available from the production of the bags to their packaging in dispenser boxes. The stacks provided with a securing means may also be transferred to a dispenser box. This facilitates handling of the stack and prevents the stack from falling apart before it enters the dispenser box. The securing means may also be removed immediately after transferring the stacks to the dispenser box or at first access to the contents of the dispenser box by the user. This ensures that the stacks will not change in shape during shipping.

In addition according to the invention the bag has at least one marking for production with an accurate repeat. Due to the precise execution of the at least one weld seam, bags having identical or almost identical dimensions are made possible. The user thus receives bags of the same volume. The marks, for example, one or more marks per bag, may also serve the user in order to always achieve the same filling levels in the bags. If the material supplied to the process has regular imprints, this ensures that each bag is provided with the proper imprint.

In addition, according to the invention the at least one fold introduced into the stack is a Z-fold, a W-fold, an accordion-type fold or a U-fold. The at least one fold in the stack that already has a formatting fold for each bag, is characterized by a change in direction of all the bags forming the stack. For example, a U-fold yields one such change in direction and a Z-fold yields two such changes in direction. More than two changes in direction (folds) are also conceivable, for example, a W-fold or an accordion-type sequence of folds. This makes it possible to adapt the stack individually to the format of the dispenser box and thus increase the packing density. The dispenser box may also accommodate one or more stacks folded in this way. These stacks may be aligned, for example, in parallel with one another, transversely to one another or also in parallel and transversely to one another in alternation. It is also conceivable to design the dispenser box with a wide variety of angles between the individual stacks.

In addition, according to the invention the formatting fold is introduced into the layered strip in such a way that the width of the layered strip after introducing the formatting fold corresponds at least to the inside dimension of one edge length of the dispenser box. In this way, a dimension of the dispenser box is transferred to the bag within the scope of the process. This ensures that the stack formed from these bags can be inserted into the dispenser box. This dimension can be varied according to the dispenser box used.

According to the invention, a bag having a lower layer of material and an upper layer of material connected by at least one weld seam is provided, and the bag has at least one opening at or almost at a right angle to the at least one weld seam. If the bags are at or almost at a right angle to the weld seam and have at least one opening, then this opening is opposite a fold.

Alternatively, according to the invention, a bag having a lower layer of material and an upper layer of material connected by at least one weld seam is provided, and the bag has at least one fold at or almost at a right angle to the at least one weld seam. The at least one fold at or almost at a right angle to the weld seam may be opposite an additional fold or an opening. If the at least one fold is opposite an opening, then the material sheeting supplied to the process consists of a half-tube. If the at least one fold is opposite another fold, then the sheet of material supplied to the process consists of a tube.

In addition, according to the invention the at least one weld seam forms a bottom seam or a side seam of the separated bag. If the weld seam forms a bottom seam, the sheet of material would be supplied as a tube to the process. If the sheet of material is in turn supplied as a half-tube, then the at least one weld seam forms a side seam of the separate bag.

In addition, according to the invention, if the at least one weld seam forms a bottom seam of the bag, an opening is formed opposite it. In this case, the sheet of material would be supplied as a tube to the process. A separation cut or a parting weld is designed to be opposite the weld seam running transversely to the processing direction of the sheet of the material at a distance corresponding to the edge length of the bag, so that the bag formed from a tubular sheet of material has only one weld seam. However, it has two folds designed at or almost at a right angle to this weld seam. This embodiment allows the production of a bag having only one weld seam.

In addition, according to the invention the bag is formed as a bottom seam bag having one weld seam. To form a bottom seam bag, the sheet of material is supplied as a tube to the process. Only one weld seam is sufficient to create a bag that is closed on three sides. An opening is provided for filling the bag. After the bag has been filled, it can be sealed by a bonding method, for example, by welding. A rubber band or a clip is also conceivable.

Alternatively according to the invention the bag is formed as a side seam bag with two weld seams. A half-tube is supplied as the sheeting of material to the process in this case. The bag that is closed on three sides after passing through the process has a bottom formed by folding as well as two weld seams disposed at or almost at a right angle to the bottom as the sides. There remains an opening formed by the folding of the sheet of material to form the half-tube. The bag, which is a side seam bag here, can be filled through this opening. After filling the bag, this bag can also be sealed by a physically bonded closure, for example, by welding. A rubber band or a clip is also conceivable.

In addition, it is also provided according to the invention that the bag has at least one mark for processing with an accurate repeat. These repeating marks make it possible to carry out work steps at intervals that are always the same, executed in the direction of travel of the sheet of material. For example, this ensures that imprints, in particular advertising imprints, will always be positioned in the same way relative to the individual bag. Thus the imprint can be carried out even on the connected sheet of material. All the bags separated later will thus have an identical appearance. These marks can help the user to achieve equal filling levels of filled material in multiple bags of the same type. For example, the marks are provided with volume information.

According to the invention, a stack is formed from bags having at least one weld seam and at least one fold, wherein this stack is made by a method according to the steps described above. This stack is designed to fit into a dispenser box, so that the items can be removed from this bag individually. For the user, this yields a high level of convenience because the user can remove the individual bags from the dispenser box by applying always the same or almost the same low force or almost the same low force. Haptically, the removal of the bags is a positive experience for the user because he need not apply any force to separate the bags.

According to the invention, a dispenser box is provided designed to receive at least one stack made by the method according to at least one of the process steps disclosed above. The dispenser box is angular, for example parallepipedal but may also be in the form of a pyramid or the like so that the boxes can be stacked easily. Their surfaces can also be printed easily and representatively. For example, printed marks, logos, product information, warnings, price labels, advertising information and the like can be shown to advantage.

The dispenser box may have at least one dispensing opening, wherein this opening may be closed until the first time a bag is dispensed. To remove the closure element, for example, a perforation may be provided, and the course of the perforation reflects the subsequent size and shape of the dispensing opening. A separate closure element may also be provided, closing the dispensing opening until the first bag is pulled out. In this case, measures such as seals may be provided to ensure that the guaranteed number of bags per packaging unit is available to the user after he acquires the dispenser box containing folded bags.

The dispenser box is preferably filled with at least one stack consisting of a defined number of bags. These bags have a formatting fold as well as a Z-fold or a U-fold, for example. After carrying out both folding operations, the stack of bags has almost the same dimensions as the inside dimensions of the dispenser box. This ensures first that the volume of the dispenser box is almost completely utilized and second that easy dispensing of the individual bags is possible. The bags are dispensed, one by one, from the outside to the inside. The user can pull out each bag individually, regardless of the fold selected for the stack. The dispenser box may be made of cardboard, metal, plastic or laminated materials, for example.

To facilitate dispensing, the bag facing the dispensing opening may be affixed to the closure element for the dispensing opening. This fixation is preferably designed so that the bag can be released easily from the closure element after being dispensed, so that it can be used. A spot of glue, for example, may be provided to affix the bag on the side of the closure element facing the bag in the closed state. It is also conceivable to form a chain of individual bags in the stack by glue spots, for example, so that the bag following the bag just dispensed is always kept in or close to the dispensing opening. If multiple stacks are introduced into a dispenser box, a connection between the stacks is also conceivable so that the bags forming the respective stack can be dispensed easily.

An auxiliary element such as an adhesive strip, for example, may also be provided on the bag of a stack provided for the initial dispensing in order to form a type of handle. This auxiliary element facilitates dispensing of the first bag for the user. Additional bags may also be provided with auxiliary elements for easier dispensing from the dispenser box. The at least one dispensing opening may also be provided on the bottom side of the dispenser box so that the force of gravity has a supporting effect in removal of the individual bags. To this end, the dispenser box is preferably disposed at an elevation, so that the user has easy access to the dispensing opening disposed on the bottom side. To support the gravity-induced effect, a weight above the stack and/or the bags in the dispenser box may also be provided. A curved spring-type element that exerts a pressure on the stack and/or on the bags in the direction of the dispensing opening may also be provided opposite the dispensing opening in the dispenser box. This ensures that the bag intended for the next dispensing is always disposed in the area of the dispensing opening.

The bag may be made of various materials, for example, plastic film. Use of thin metal films is also conceivable. Tubular, half-tube or sheet knits, nonwovens or the like can also be used in the process. Ultimately all tubular, half-tube or sheet materials that can be joined by bonding can be used and are suitable for forming bags. Then stacks of these bags can in turn be created for introduction into dispenser boxes, for example.

In other words according to the invention any designs of bags, in particular plastic bags, are first made available in a continuous sheet. This continuous sheet is then folded at least once symmetrically with the longitudinal axis or asymmetrically with the continuous sheet that is provided so that subareas, optionally complete areas of the continuous bag sheet will then overlap or even rest one on top of the other.

In a next step, the individual bags that have until then been connected to one another are separated from one another at predetermined locations on the folded continuous sheet. This may be accomplished in a known way by cutting or some similar process. The bags folded in this way and separated from the continuous sheet are then placed one on top of the other to form a package or are folded together again. This takes place for a predetermined number of pieces. The number of pieces depends in particular on the volume of the dispenser box in which the folded bags placed one on top of the other are to be placed. It is also conceivable here for each individual bag to be folded at least once more in parallel, transversely or in some other direction in order to adapt the format of the bag, which is subsequently finish-folded, to the space inside the dispenser box.

Next, a dispenser box is provided, and a stack of folded bags in a predetermined number is then introduced into the dispenser box. These boxes can then be shipped and sent for their use.

The at least one fold before separation of the individual bags from the continuous sheet then takes place in such a way that bags are made available in a predetermined number in a stack after being separated. If this stack is placed in the dispenser box, this makes it possible to remove individual bags from this dispenser box. This eliminates any additional separation of these bags on removal from the dispenser box in an advantageous manner.

In addition to the at least one fold before separation, it is also conceivable for the individual separated bags to be folded at least once again and/or for the bags placed in the stack in a certain number to be folded at least once more. These additional folds have the disadvantage that this alters the dimensions of the respective bag (length, width), in particular reducing them, and therefore it is not only possible to better utilize the available space in the dispenser box but also the format of the stack with folded bags can be adapted to the format of the dispenser box.

As a rule, the bags have a format with square dimensions (longitudinal side=wide side) or rectangular dimensions. It is also advantageous accordingly if the dispenser box has square or rectangular dimensions. However, it is also possible for the dispenser box to have, for example, a triangular format and for the bag separated from the continuous sheet to be folded at least once so that it assumes the corresponding triangular shape of the dispenser box for being deposited in a stack in the dispenser box.

It is important for the bags to be folded in such a way that they are placed individually in stacks and can be placed in the angular dispenser box. The angular format of the dispenser box has the important advantage that the available space is utilized optimally during shipping and subsequent presentation (for example, on a shelf in a supermarket). Furthermore, such an angular dispenser box offers the important advantage that it can easily be provided with product information in a known way.

An illustrated embodiment of the invention is described in greater detail below with reference to the accompanying drawing in which.

Figure 3A:
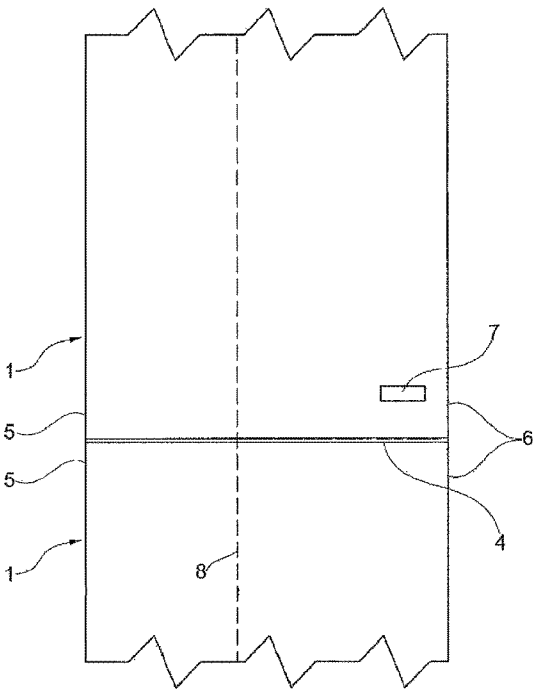
FIGS. 3A and 3B show connected bags with a single fold according to FIGS. 1A and 1B.

In the following description of the figures, the terms such as top/upper, bottom/lower, left, right, front, rear, etc. refer exclusively to the selected exemplary presentation and position of the apparatus in the respective figures and other elements. These terms are not to be understood as restrictive, i.e. these references may change due to different orientations and/or mirror symmetrical layout or the like.

The same elements are always shown with the same reference numerals in all figures as well as in the following description.

Any designs of the bags 1, in particular film bags, are made originally from a continuous sheet of material. This endless sheet of material is then folded at least once symmetrically with the longitudinal axis or asymmetrically with the endless strip of material thereby supplied, so that subareas (optionally complete areas of the continuous bag sheet) then optionally overlap or may even lie one on top of the other.

Figure 1A:
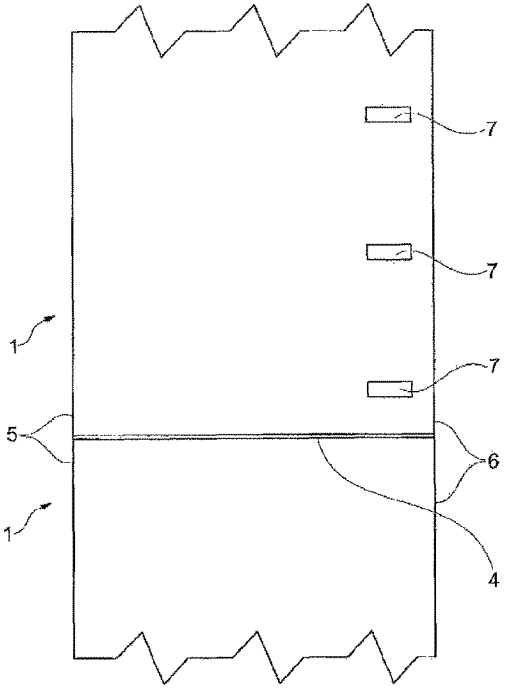
FIGS. 1A and 1B show connected bags made from a half-tube.
Figure 1B:
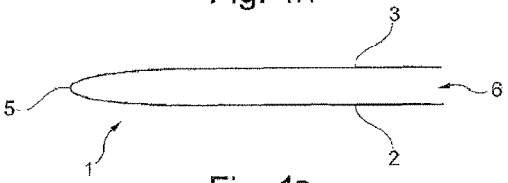

FIGS. 1A and 1B show two connected bags 1 formed from a half-tube with a lower layer of material 2 and an upper layer of material 3. At least one weld seam 4 for connecting the layers of material 2, 3 is situated at the dividing point between the two bags. A side of the bag 1 disposed at or almost at a right angle to the weld seam 4 is formed by a fold 5. A side of the bag 1 opposite the fold 5 has an opening 6. Marks 7 are provided at regular intervals close to the side of the bag having the opening 6. These marks are used for production of the bags 1 with an accurate repeat. Due to these marks 7, it is possible, for example, to position the weld seam 4 in such a manner that precise repeat production is achieved. For example, if imprints, in particular advertising imprints, are applied to the bags 1, they can always be positioned precisely for the individual bag 1 through welding.

FIG. 1B shows schematically a section through a bag according to FIG. 1A outside of the weld seam 4 and parallel to the weld seam 4. This shows clearly the opening 6 opposite the fold 5. The fold 5 is to be interpreted as a reversal of direction for the material forming the bag 1. It may be designed as a hard fold in the sense of a fold with a rounding.

In deviation from FIGS. 1A and 1B, FIGS. 2A and 2B show two connected bags 1 formed from a tube with a lower layer of material 2 and an upper layer of material 3. There is one fold 5 opposite the weld seam at or almost at a right angle to the weld seam 4.

Figure 2A:
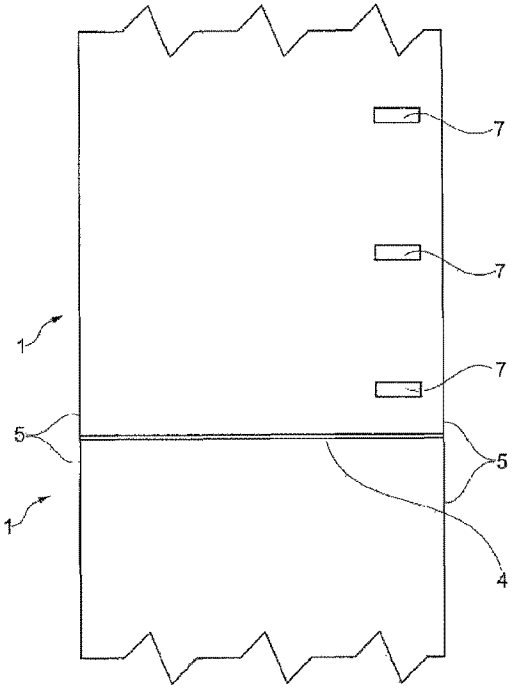
FIGS. 2A and 2B show connected bags made from a tube.
Figure 2B:
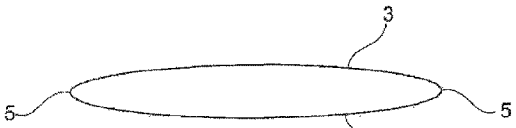

FIG. 2B shows schematically a section through the bag according to FIG. 2A outside but parallel to the weld seam 4. This shows clearly that two folds 5 are opposite one another.

Figure 3B:
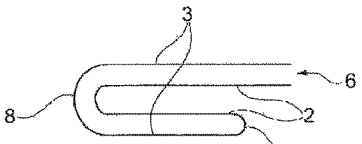

FIGS. 3A, 3B, 4A and 4B show a formatting fold 8 in the sheet of material comprised of connected bags 1. FIGS. 3A and 3B show connected bags 1 with an opening 6 according to FIGS. 1A and 1B. FIG. 3B shows schematically a sectional view according to FIG. 3A in the area outside but parallel to the weld seam 4. This shows the opening 6 clearly.

Figure 4A:
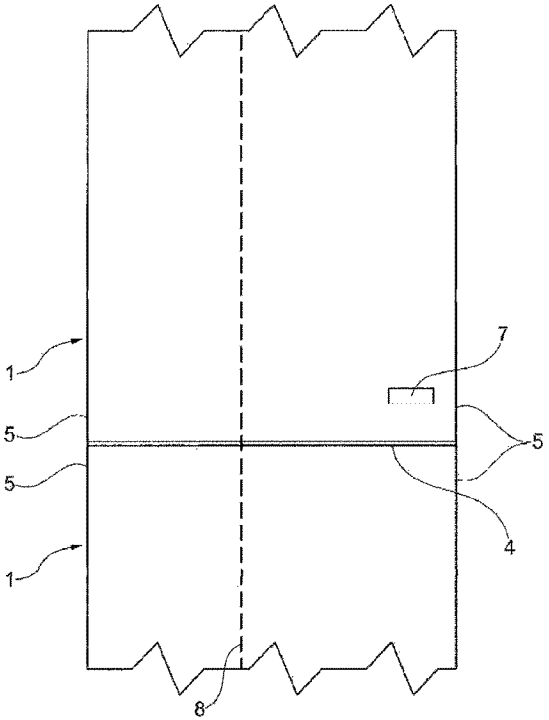
FIGS. 4A and 4B show connected bags with a single fold according to FIGS. 2A and 2B.
Figure 4B:
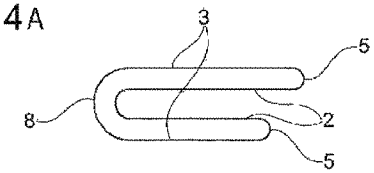

FIGS. 4A and 4B show connected bags 1 according to FIGS. 2A and 2B. FIG. 4B shows schematically a sectional view according to FIG. 4A in the area outside but parallel to the weld seam 4. This shows clearly two opposing folds 5 before the introduction of the formatting fold 8.

Figure 5:
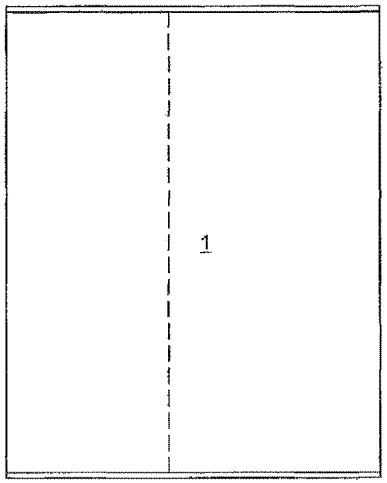
FIG. 5 shows a separated bag according to FIGS. 1A and 1B.

FIG. 5 shows a separated bag 1 that may have a fold 5 and an opening 6 according to FIGS. 1A, 1B, 3A and 3B or two folds 5 according to FIGS. 2A, 2B, 4A and 4B.

The separation of the bags 1 from the sheet of material takes place by cutting or by separation welding, for example. With the bags 1 according to FIGS. 1A, 1B, 3A and 3B, an opening may be provided opposite a weld seam 4.

Figure 6:
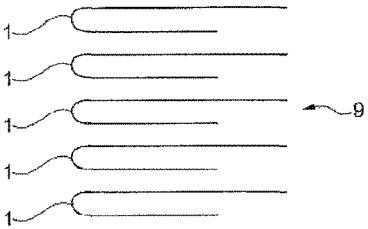
FIG. 6 shows a package formed from the separated bags according to FIG. 5.

FIG. 6 shows a package formed by collecting individual bags 1 to form a stack 9. This stack 9 is formed continuously from individual bags 1.

Figure 7A:
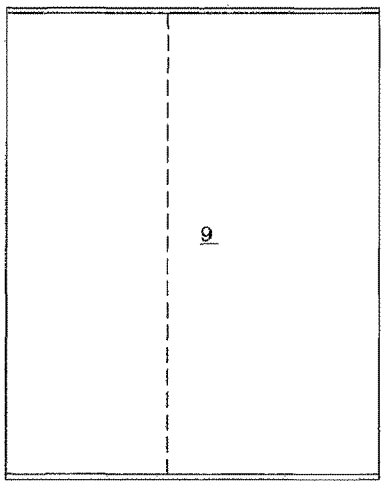
FIGS. 7A, 7B and 7C show variants of the folding of the package of bags according to FIG. 6.

FIG. 7A shows a top view of a stack 9 according FIG. 6.

Figure 7C:
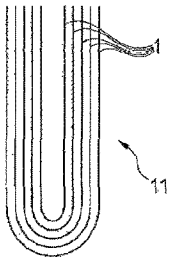
Figure 7B:
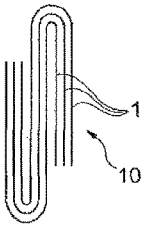

FIGS. 7B and 7C show variants for further folding of a stack 9.

Figure 8:
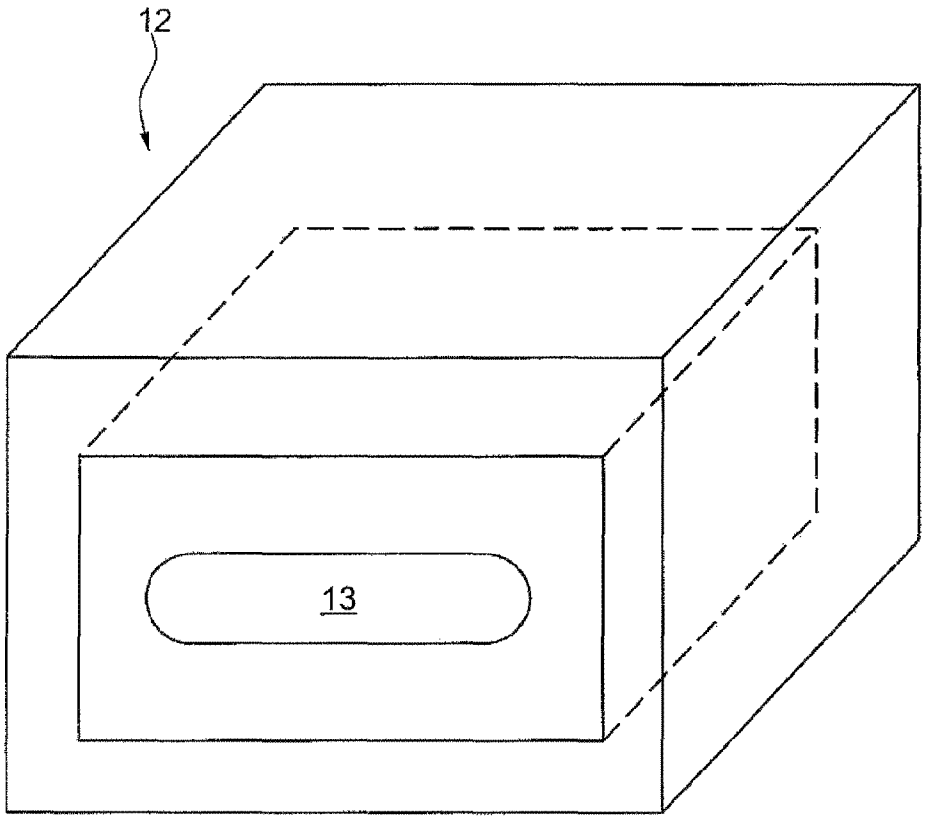
FIG. 8 shows a dispenser box for holding the folded package of bags according to FIG. 7.

FIG. 7B shows a Z-fold 10 and FIG. 7C shows a U-fold 11. The stacks 9 of bags 1 designed with a Z-fold 10 or with a U-fold 11 are transferred to a dispenser box 12 according to FIG. 8. The bags 1 can easily be dispensed individually from this dispenser box 12 by pulling them through the at least one dispensing opening 13. Due to the folding, in particular the U-fold 11 or the Z-fold 10, one bag 1 is always ready for the user to grip it in the area of the at least one dispensing opening 13. When removing a bag 1, this bag 1 slides over at least one bag 1 remaining in the dispenser box.

LIST OF REFERENCE NUMERALS

1 bag
2 lower layer of material
3 upper layer of material
4 weld seam
5 fold
6 opening
7 mark
8 formatting fold
9 stack
10 Z-fold
11 U-fold
12 dispenser box
13 dispensing opening

The invention claimed is:

1. A method of making at least one stack from bags, the method comprising the steps of sequentially:

forming from tubular material or half-tube material a longitudinally extending lower layer of material and a longitudinally extending upper layer of material thereon, joining the lower layer by at least one transversely extending weld seam to the upper layer of material to form a longitudinally extending layered strip of bags that are still attached to one another, creating a longitudinally extending formatting fold in the layered strip of bags that are attached to one another, longitudinally separating the bags that are still attached to one another in the format folded layered strip to form bags such that these folded bags still each have the individual formatting fold, forming a stack from the folded bags, forming a fold in the stack of folded bags, and transferring the folded stack to a dispenser box.

2. The method according to claim 1, further comprising the step of:

providing the stack with a safeguard to prevent the stack from unintentionally falling apart.

3. The method according to claim 1, wherein the at least one weld seam is carried out on each bag with a precise repeat production on the basis of at least one mark.

4. The method according to claim 1, wherein the fold formed in the stack is one of a Z-fold, a W-fold, an accordion fold and a U-fold.

5. The method according to claim 1, further comprising the step of:

creating the formatting fold in the layered strip in such a way that the width of the layered strip corresponds at least to an inside dimension of one edge length of the dispenser box after creating the formatting fold.

6. A method of making at least one stack from bags, the method comprising the steps of sequentially:

forming from tubular material or half-tube material a longitudinally extending lower layer of material and a longitudinally extending upper layer of material thereon, joining the lower layer by at least one transversely extending weld seam to the upper layer of material to form a longitudinally extending layered strip of bags that are still attached to one another, creating a longitudinally extending formatting fold in the layered strip of bags that are attached to one another, longitudinally separating the bags that are still attached to one another in the format folded layered strip to form bags such that these folded bags still each have the formatting fold, forming a stack from the folded bags, forming a fold in the stack of folded bags, and packaging the folded stack.

7. The method according to claim 6, further comprising the step of:

providing the stack with a safeguard to prevent the stack from unintentionally falling apart.

8. The method according to claim 6, wherein the at least one weld seam is carried out on each bag with a precise repeat production on the basis of at least one mark.

9. The method according to claim 6, wherein the fold formed in the stack is one of a Z-fold, a W-fold, an accordion fold and a U-fold.

10. The method according to claim 6, further comprising the step of:

creating the formatting fold in the layered strip in such a way that the width of the layered strip corresponds at least to an inside dimension of one edge length of a package after creating the formatting fold.

* * * * *